US008443620B2

(12) United States Patent
Choi et al.

(10) Patent No.: US 8,443,620 B2
(45) Date of Patent: May 21, 2013

(54) ICE TRAY ASSEMBLY AND REFRIGERATOR HAVING SAME

(75) Inventors: Seung Jin Choi, Gimhae (KR); Yong Chol Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 788 days.

(21) Appl. No.: 11/836,355

(22) Filed: Aug. 9, 2007

(65) Prior Publication Data

US 2008/0041089 A1 Feb. 21, 2008

Related U.S. Application Data

(60) Provisional application No. 60/837,626, filed on Aug. 15, 2006.

(51) Int. Cl.
*F25C 1/00* (2006.01)

(52) U.S. Cl.
USPC ..... 62/347; 62/344; 62/353

(58) Field of Classification Search
USPC ..... 62/344, 353, 347
See application file for complete search history.

(56) References Cited

U.S. PATENT DOCUMENTS

| | | | | |
|---|---|---|---|---|
| 5,012,655 | A * | 5/1991 | Chatterton | 62/340 |
| 5,135,645 | A * | 8/1992 | Sklenak et al. | 210/97 |
| 5,904,054 | A * | 5/1999 | Lee | 62/347 |
| 6,003,734 | A * | 12/1999 | Oh | 222/146.6 |
| 6,938,428 | B2 * | 9/2005 | Onishi et al. | 62/135 |
| 7,010,934 | B2 * | 3/2006 | Choi et al. | 62/353 |
| 7,437,885 | B2 * | 10/2008 | Wu et al. | 62/344 |

* cited by examiner

*Primary Examiner* — Cheryl J Tyler
*Assistant Examiner* — Lakiya Rogers
(74) *Attorney, Agent, or Firm* — KED & Associates, LLP

(57) ABSTRACT

An ice tray assembly for a refrigerator is provided. The ice tray assembly is installed in a door of a refrigerator. The ice tray assembly allows water to be supplied from a water container to an ice tray only when the door is closed. To this end, the ice tray assembly includes a valve for opening and closing a channel through which the water is supplied from the water container to the ice tray which is operated in cooperation with the operation of the door. An inner space of a refrigerator main body and corresponding storage space is increased since the ice tray assembly is installed in the door. Further, because water fed from the water container to the ice tray is controlled according to the operation of the door, water is not spilt from the ice tray when the door is operated.

11 Claims, 15 Drawing Sheets

ICE TRAY ASSEMBLY AND REFRIGERATOR HAVING SAME

CROSS-REFERENCE TO RELATED APPLICATION(S)

This application claims priority under 35 U.S.C. §119 to U.S. Provisional Application No. 60/837,626 filed on Aug. 15, 2006, whose entire disclosure is hereby incorporated by reference.

BACKGROUND

1. Field

The field relates to a tray assembly, and more particularly, to an ice tray assembly and a refrigerator having the same.

2. Background

Generally, refrigerators include a refrigerating chamber and a freezing chamber in which perishable items may be stored. It is often desirable to include provisions for making and storing ice in the freezing chamber. However, the various components required to provide this ice making and storing capacity often consume useable storage space in the refrigerating/freezing chamber; thus decreasing the storage space available to store other perishable items.

BRIEF DESCRIPTION OF THE DRAWINGS

The embodiments will be described in detail with reference to the following drawings in which like reference numerals refer to like elements wherein.

DETAILED DESCRIPTION

Figure 1:
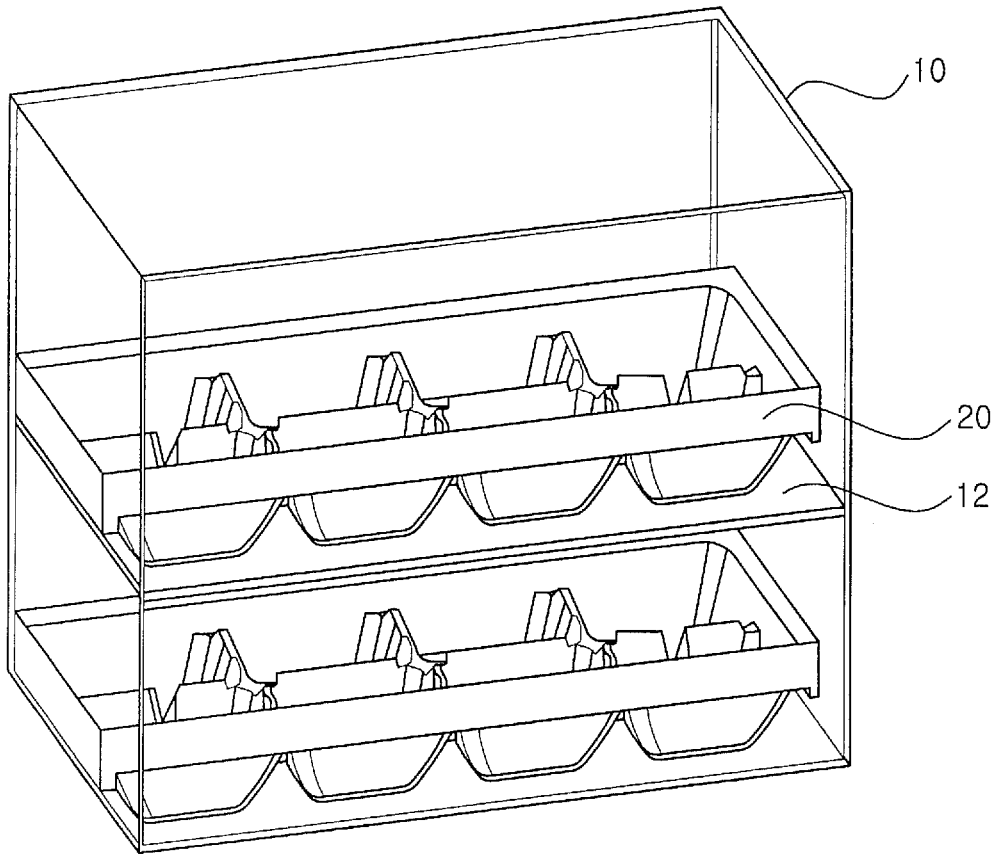
FIG. 1 is a front perspective view of an exemplary ice tray assembly for a refrigerator.

FIG. 1 illustrates an ice tray assembly for a refrigerator, comprising a case 10, and a shelf 12 provided in the case 10 so that an ice tray 20 may be placed on the shelf 12. The ice tray 20 has an inner space divided into a plurality of subspaces in which ice may be formed. To make ice, the ice tray 20 is taken out of the refrigerator and filled with water, and then returned to the case 10 in the refrigerator to freeze.

However, since the ice tray assembly and its corresponding components are positioned in a storage space in the refrigerator, the ice tray assembly detracts from the storage space of the refrigerator which would otherwise be available for the storage of perishable items. Additionally, water may be spilt in the storage space due to carelessness when the ice tray 20 is returned to the case 10.

Figure 2:
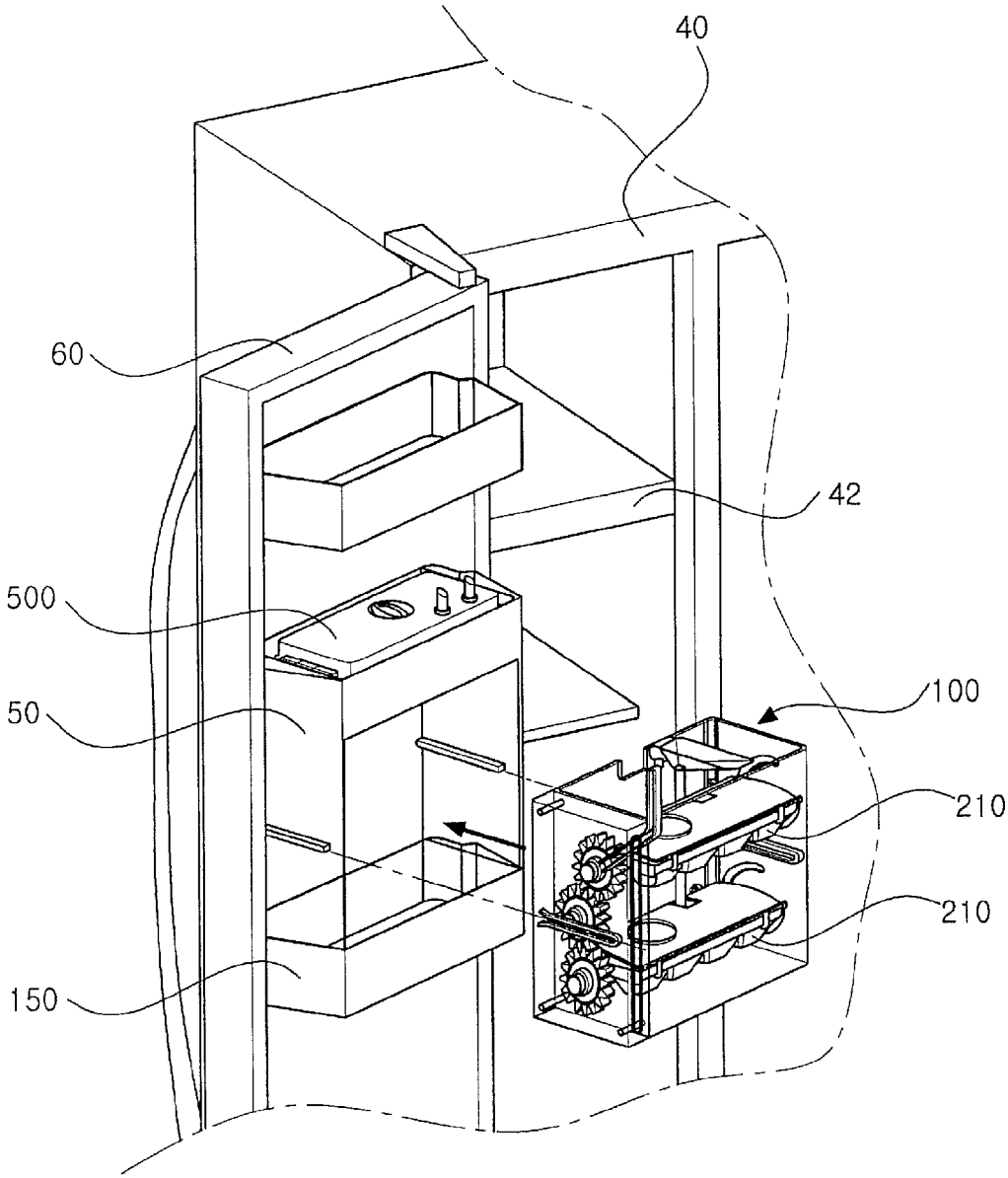
FIG. 2 is a partial front perspective view of an exemplary refrigerator having an ice tray assembly as embodied and broadly described herein.

The refrigerator shown in FIG. 2 includes an exemplary ice tray assembly as embodied and broadly described herein. The refrigerator may include a door 60 which opens and closes a refrigerator main body 40 provided therein with a storage space in which cold air circulates for the storage of perishable items and the like. The ice tray assembly may be installed in the door 60, and may include an outer case 50, an inner case 100, an ice tray 210 and a water bucket 500. As shown in FIG. 2, the outer case 50 may be mounted at the door 60, the inner case 100 may be inserted into the outer case 50, and the water bucket 500 may be positioned at an upper side of the outer case 50 in order to feed water to the ice tray 210. The storage space formed in the refrigerator main body 40 may be divided by, for example, a shelf 42 or other suitable component. In the embodiment shown in FIG. 2, when the door 60 is closed, a bottom surface of a front end of the shelf 42 is positioned over the water bucket 500.

Figure 3:
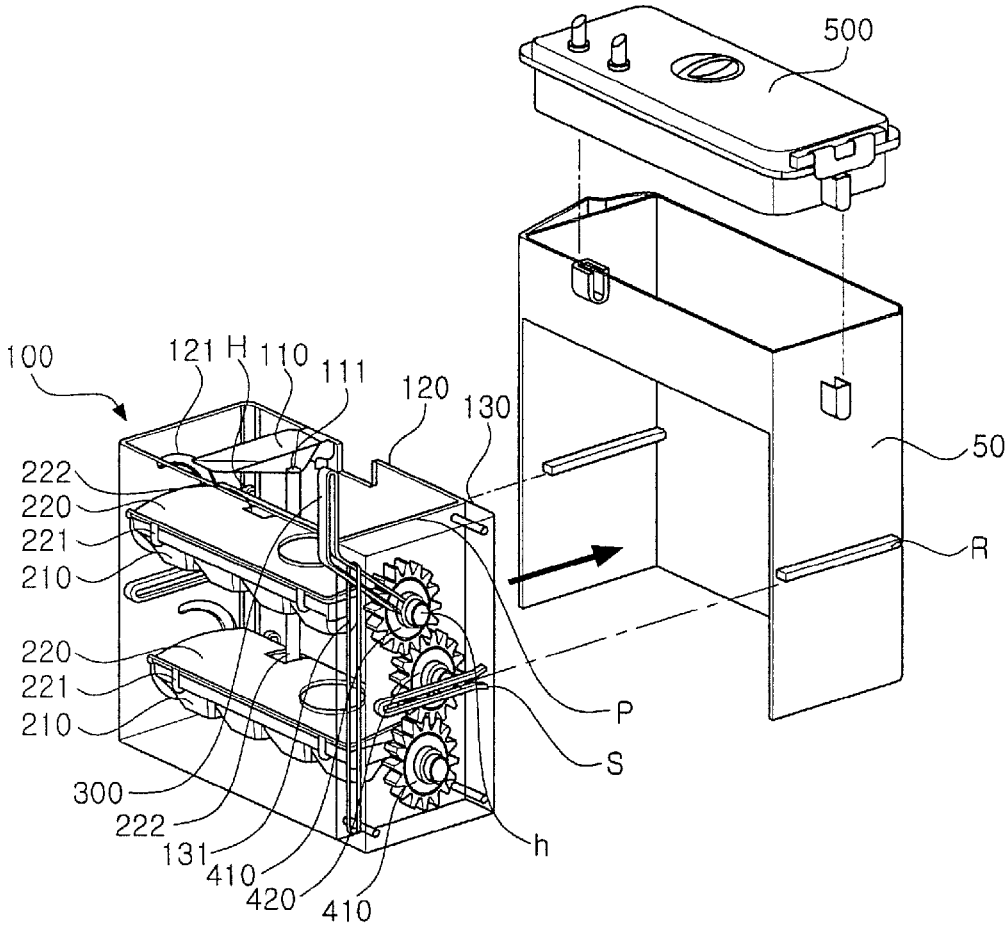
FIG. 3 is an exploded perspective view of an exemplary ice tray assembly for a refrigerator as embodied and broadly described herein.

As shown in FIG. 3, in addition to the outer case 50, the inner case 100, the ice tray(s) 210, and the water bucket 500, the ice tray assembly may also include a rotary lever 300, a rotary gear 410 for each ice tray 210, and a connection gear 420 between each pair of rotary gears 410.

The inner case 100 may be detachably inserted into the outer case 50. In certain embodiments, the outer case 50 may be formed in a vertically extending hexahedral shape so that a plurality of the ice trays 210 may be vertically arranged, as shown in FIGS. 2-3. Other arrangements may also be appropriate. The outer case 50 may have a surface corresponding to an inner surface of the refrigerator door 60 so that the outer case 50 is installed in the refrigerator door 60. Accordingly, since the ice tray assembly can be mounted on the refrigerator door 60, it is possible to minimize the space which is occupied by the ice tray assembly. The opposite surface of the outer case 50 may be open so that the inner case 100 can be inserted into and separated from the outer case 50.

The outer case 50 may include a rib R to guide the mounting and dismounting of the inner case 100. In the embodiment shown in FIGS. 2 and 3, the rib R protrudes from an inner surface of the outer case 50 and extends in the direction in which the inner case 100 is inserted. A rib R may be formed on each of both inner side surfaces of the outer case 50 for stable insertion and separation of the inner case 100. Other quantities, locations and orientations of the rib(s) R may also be appropriate. For example, in alternative embodiments, the rib(s) R may be instead formed on the inner case 100.

In certain embodiments, the inner case 100 may be formed in a vertically extending hexahedral shape so as to correspond to the outer case 50, with the plurality of ice trays 210 arranged vertically. A lower face of the inner case 100 may be open so that ice falling from the plurality of ice trays 210 passes therethrough and into a bin 150. In certain embodiments, at least one side surface of the inner case 100 is formed of a transparent material so that a state of ice freezing in the plurality of the ice trays 210 can be confirmed from outside of the inner case 100, and without separating the inner case 100 from the outer case 50. Likewise, a portion of the inner case 100 may be open so that ice in the bin 150 is accessible when the door 60 is open. In alternative embodiments, corresponding openings may be formed in the door 60, the inner case 100 and the outer case 50 so that ice in the bin 150 is accessible from outside the refrigerator, without opening the door 60.

As shown in FIG. 3, the inner case 100 may include a water feeding channel 110, an ice making portion 120 and a driving portion 130. The ice making portion 120 and the driving portion 130 may be arranged sequentially, with a partition P dividing the ice making portion 120 and the driving portion 130 from each other. The inner case 100 may also include holes h into which the rotary gears 410 and the connection gear 420 are inserted. The holes h may be formed in the partition P, as shown in FIG. 3.

The water feeding channel 110 feeds water discharged from the water bucket 500 to any one of the plurality of ice trays 210. The water feeding channel 110 may be formed in a funnel shape, or other shapes as appropriate so as to collect water from the water bucket 500 and direct it into an ice tray 210 through a tube 111. The water bucket 500 may be detached from the assembly and manually filled with water. In alternative embodiments, the water bucket 500 may be connected to a water supply and valve so that the water bucket 500 may be automatically filled as necessary.

The driving portion 130 may include a lever opening 131 which opens vertically so that the rotary lever 300 passes through the lever opening 131 and is accessible for operation.

The inner case 100 may include a slot S formed on an outer surface of the driving portion 130 and extending in the direction in which the inner case 100 is inserted into the outer case 50, so that the rib R provided on the outer case 50 is inserted into the slot S. Accordingly, the outer case 50 and the inner case 100 may be stably coupled and decoupled. In alternative embodiments, the slots S may be formed on the outer case 50 and the ribs R may be formed on the inner case 100 in quantities and locations as appropriate.

The inner case 100 may also include grooves 121 for limiting a rotational angle of the ice trays 210. The grooves 121 may be formed in a surface of the ice making portion 120, as shown, for example, in FIG. 3.

Each of the plurality of ice trays 210 may also include a cover 220 for sanitation purposes, and for preventing water or ice contained in the ice tray 210 from escaping. The cover 220 may include a feeding port 222 for receiving the water from above the ice tray 210 through the water feeding channel 110 and tube 111.

The cover 220 may also include hooks 221 which keep the cover 220 in place even in the event of an impact occurring when the refrigerator door 60 is opened and closed. The inner case 100 may also include a rod (not shown) which causes the cover 220 to open when the ice tray 210 is rotated and the ice is separated from the ice tray 210.

The cover 220 may be connected to the ice tray 210 through a hinge H. The hinge H may be connected to a side of the ice tray 210 with respect to a longitudinal axis thereof based on a rotational direction of the ice tray 210. For example, if the ice tray 210 is rotated clockwise, the hinge H is positioned at a left side in order to open the cover 220 when the ice tray 210 is rotated. Likewise, the hinge H is positioned at a right side with respect to the longitudinal axis of the ice tray 210 if the ice tray 210 is rotated counterclockwise. In the exemplary embodiment shown in FIGS. 2 and 3, the ice tray 210 is rotated counterclockwise, and the hinge H is connected to the right side of the ice tray 210 with respect to the longitudinal axis of the ice tray 210. Accordingly, the cover 220 is opened when the ice tray 210 is rotated, so that the ice separated from the ice tray 210 falls into the bin 150 positioned below the ice tray(s) 210.

The ice tray 210 may also include protrusions (not shown) which are inserted into the grooves 121 provided in the inner case 100 to limit the rotational angle of the ice trays 210. In alternative embodiments, the grooves 121 may instead be formed in the ice trays 210 and the protrusion may be formed in the inner case 100. In the exemplary ice tray assembly shown in FIGS. 2 and 3, the grooves 121 and protrusions limit the rotation angle of the left side of the trays 210, while the right side of the trays 210 rotates based on a position of the lever 300 and degree of rotation of the lever 300 as it is pulled. This allows the ices trays 210 some degree of twist, if necessary, to release the ice into the bin 150.

In the exemplary embodiment shown in FIGS. 2 and 3, the plurality of ice trays 210 are arranged vertically, and each of the ice trays 210 rotates in the inner case 100. To this end, the longitudinal axis of the ice tray 210 may be connected to the rotary gear 410, the axis of which is inserted into a hole (not shown) provided in another surface of the ice making portion 120 and the hole h provided in the partition P dividing the ice making portion 120 and the driving portion 130 from each other. The plurality of ice trays 210 may be appropriately spaced apart so that the plurality of ice trays 210 do not interfere with each other when each of the plurality of ice trays 210 is rotated and the ice is separated from the ice tray 210. In the embodiment shown in FIGS. 2 and 3, the ice tray 210 is inclined from a left upper side to a right lower side as viewed from the front of the inner case 100.

The rotary lever 300 may have a first end connected to any one of the plurality of ice trays 210 and a second other end protruding out of the inner case 100 through the lever opening 131 provided in the driving portion 130, thereby pivoting on the longitudinal axis of the one of the plurality of ice trays 210. In order to provide adequate space when the rotary lever 300 is rotated, the rotary lever 300 may be connected to the ice tray 210 positioned in an upper portion in the inner case 100 in which the rotary lever 300 pivots, and the rotary lever 300 pivot counterclockwise. However, other arrangements may also be appropriate.

The plurality of rotary gears 410 may be respectively connected to the plurality of ice trays 210 and may be meshed with each other. The plurality of rotary gears 410 may be respectively connected to the longitudinal axes of the plurality of ice trays 210. In order to be rotated at the same angular rate, the rotary gears 410 may each have the same gear ratio. The connection gear(s) 420 connects the plurality of rotary gears 410 so that the plurality of ice trays 210 are rotated in the same direction as the rotary lever 300. In order for the plurality of ice trays 210 to rotate in the same direction as the rotary lever 300, the connection gear 420 may be positioned between adjacent rotary gears 410. The rotary lever 300 shown in this embodiment may be manually operated to rotate the gears 410 and 420. In alternative embodiments, operation of the gears 410 and 420 and/or lever may instead be automated to facilitate rotation of the trays 210.

Figure 4:
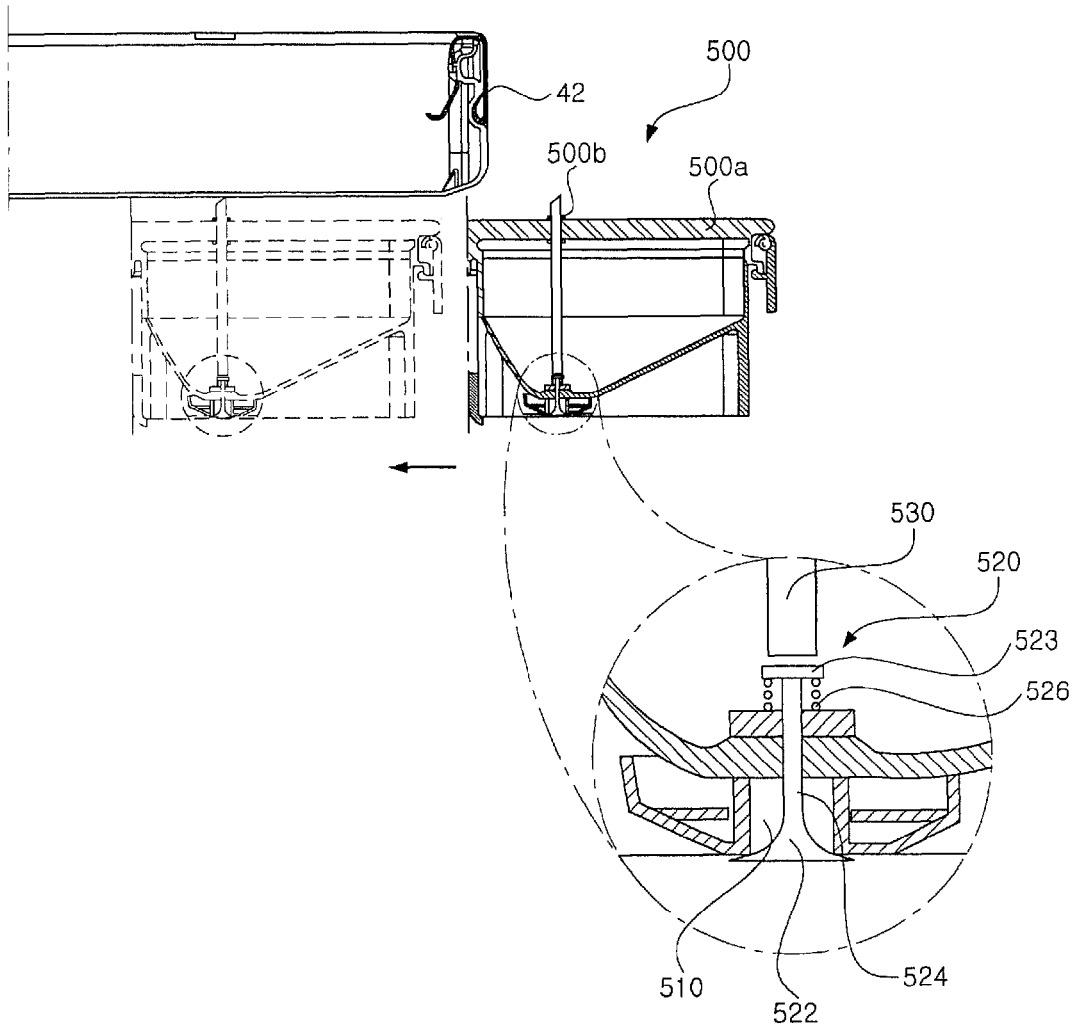
FIG. 4 illustrates operation of a water bucket provided with the exemplary ice tray assembly for a refrigerator shown in FIG. 3.

FIG. 4 illustrates the operation of the water bucket 500 provided in the ice tray assembly in cooperation with the closing of the door 60. The water bucket 500 may include a water hole 510, a valve 520 and a lever 530. The water hole 510 may be formed in a bottom of the water bucket 500 to supply the ice tray 210 with water. In alternative embodiments, a plurality of water holes 510 may be formed to supply water to the plurality of ice trays 210, in a plurality of different locations as appropriate.

The valve 520 may include a head 522, a stem 524 and an elastic member 526. The head 522 may be positioned in a lower end of the water hole 510 to open and close the water hole 510. The stem 524 extends from the head 522 into an interior of the water bucket 500 with a projecting portion 523 formed so that the elastic member 526 can be inserted between the water hole 510 and the stem 524. In certain embodiments, the elastic member 526 may be a coil spring. Accordingly, the head 522 moves up and down, and thus opens and closes the water hole 510.

The lever 530 causes the valve 520 to be opened in cooperation with the closing of the door 60. As shown in FIG. 4, the lever 530 extends from outside of the water bucket 500 to the projecting portion 523 connected to the stem 524 in order to open the valve 520 from the outside of the water bucket 500. The lever 530 penetrates a lid 500*a* of the water bucket 500 so that the lever 530 protrudes out of the water bucket 500, with a sealing portion 500*b* disposed between the lever 530 and the lid 500*a*. The sealing portion 500*b* also guides the movement of the lever 530 so that the lever 530 is moved up and down and thus opens the valve 520.

With the water bucket 500 so configured, the lever 530 is pressed by the shelf 42 provided in the storage chamber when the door 60 is closed, causing lever 530 to open the valve 520 and supply the ice tray 210 with water. The upper end of the lever 530 which contacts the shelf 42 may be inclined to facilitate its contact with the shelf 42 as the door 60 is opened and closed.

An ice tray assembly for a refrigerator in accordance with another embodiment as broadly described herein will be described with reference to FIGS. 5 to 8.

As shown in FIGS. 5-8, an ice tray assembly 620 may be mounted on a rear surface of a door 610 which opens and closed a storage space 602 defined in a refrigerator main body 600. An inclined flared surface 604 may be formed along a front end of an inside surface of the storage space 602.

A door liner defining a rear surface of the door 610 may include dikes 612, which extend in parallel from opposite ends of the rear surface. A door basket 614 may be installed between the dikes 612 to accommodate stored goods.

The ice tray assembly 620 may be installed on the rear surface of the door 610. The basic configuration of the ice tray assembly 620 may be similar to that of the embodiment illustrated in FIG. 2. However, a manner of driving a valve 626 or an ice tray 638, which will be described below, is somewhat different. Additionally, a valve opening and closing mechanism 650 for driving the valve 626 for water feeding to be described below may also be applied to the ice tray assembly illustrated in FIG. 2.

An external appearance of the ice tray assembly 620 is defined by a case 622. The case 622 may be formed in a generally rectangular hexahedral shape, and correspond to the inner case illustrated in the aforementioned embodiment. An outer case may be mounted to the door 620. A water bucket 624 may be provided at an upper portion of the case 622. The water bucket 624 is configured so that a user directly fills the interior thereof with water. That is, after separating the water bucket 624 from the case 622 and filling the interior thereof with water, the water bucket 624 may be re-connected to the case 622. The water bucket 624 may be mounted on the upper end of the case 622 as in the embodiment shown in FIG. 2. In alternative embodiments such as the embodiment shown in FIGS. 5-8, the water bucket 624 is configured so as to be inserted into the interior of the case 622 from its front.

Figure 7:
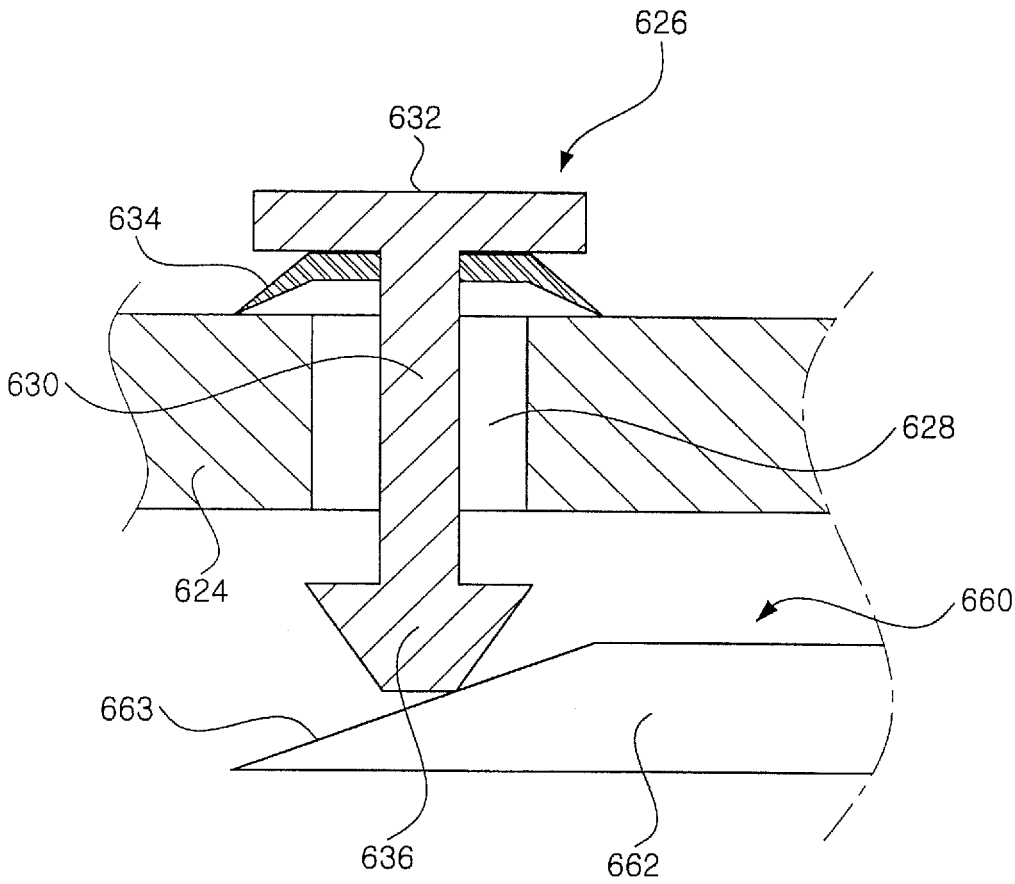

As shown in FIG. 7, a valve 626 may be provided in a bottom of the water bucket 624. A water discharging hole 628 may be formed in the bottom of the water bucket 624, or may be formed in an additional valve body (not shown) installed in the bottom of the water bucket 624. A valve stem 630 passes through the water discharging hole 628. The valve stem 630 has an outer diameter smaller than an inner diameter of the water discharging hole 628, so that water can be discharged through a gap between the water discharging hole 628 and the valve stem 630.

A plug 632 may be provided at an upper end of the valve stem 630, i.e., at a portion of the valve stem 630 which is positioned in the interior of the water bucket 624, and a sealing material 634 may be installed between the plug 632 and the floor surface of the water bucket 624 or the valve body. The sealing material 634 may be made of a soft material with elasticity, thereby serving to seal between the plug 632 and the floor surface of the water bucket 624. A cooperating portion 636 may be provided at a lower end of the valve stem 630. The cooperating portion 636 may protrude out of the water bucket 624, with an inclined surface which cooperates with an opening and closing drive inclined surface 663 of an opening and closing lever 660.

An ice tray 638 may be installed in the interior of the case 622 corresponding to the lower portion of the water bucket 624. The ice tray 638 is configured so that its interior is open on an upper side, and is partitioned into a plurality of spaces. A cover as in the previous embodiment may also be provided. The ice tray 638 is rotated by a predetermined angle about a rotational axis 639 by a force imposed on a rotary lever 640 installed outside of the case 622.

A storage container 642 for storing ice made in the ice tray 638 may be provided below the ice tray 638. The storage container 642 has an open upper portion facing a bottom surface of the ice tray 638 so as to directly receive and store ice which falls from the ice tray 638 by the rotation thereof.

The valve opening and closing mechanism 650 for opening and closing the valve 628 of the water bucket 624 may be provided in the case 622. The valve opening and closing mechanism 650 is operated in cooperation with the operation of the door 610. The valve opening and closing mechanism 650 may include a driving cam 652. The driving cam 652 has a side which protrudes outside of the case 622 in order to be in contact with the inner surface of the refrigerator main body 600. The driving cam 652 may be rotatably installed about a rotational center pin 654, and may be supported by an elastic member 656, such as, for example, a torsion spring, so as to be always in contact with the inner surface of the refrigerator main body 600. The elastic member 656 is installed so that the rotational center pin 654 passes through the center of the elastic member 656 and both ends of the elastic member 656 are supported on the driving cam 652 and the case 622 or a side of the door 610. Therefore, the driving cam 652 tends to be rotated so that it is always in close contact with the inner surface of the refrigerator main body 600 by the elastic force of the elastic member 656.

The opening and closing lever 660 may be connected to the driving cam 652 and driven together by the operation of the driving cam 652. That is, if the driving cam 652 is rotated about the rotational center pin 654, the opening and closing lever 660 is also moved. As such, the opening and closing lever 660 may be rotatably connected to the driving cam 652 through a connecting hinge pin 658. Thus, if the driving cam 652 is rotated, the connecting hinge pin 658 draws a circular trace about the rotational center pin 654. Therefore, in order to translate the opening and closing lever 660, for example, the case 622 may be provided with an additional guide rib or the like for guiding the opening and closing lever 660. If the connecting hinge pin 658 is fixed to the driving cam 652, the opening and closing lever 660 may be formed with a long narrow opening such as, for example, a slot in which the connecting hinge pin 658 is seated, so as to provide for smooth operation of the opening and closing lever 660.

A lift driving portion 662 may be provided at a distal end portion of the opening and closing lever 660. The lift driving portion 662 cooperates with the cooperating portion 636 of the valve stem 630. The lift driving portion 662 may include an opening and closing drive inclined surface 663 which is inclined to be lower as it goes to the distal end of the lift driving portion 662. The cooperating portion 636 of the valve stem 630 is guided on the inclined surface 663, thereby causing the water discharging hole 628 to be opened and closed. The lift driving portion 662 of the opening and closing lever 660 may include a cutaway portion 664 which allows water escaping from the water discharging hole 628 to be smoothly delivered to the ice tray 638.

In a case in which there are a plurality of ice trays 638, a corresponding plurality of valve opening and closing mechanisms 650 and valves 626 may also be provided. In addition, each of the valves 626 may be formed at a position in which the water can be delivered without interference to the corresponding ice tray 638.

Operation of an ice tray assembly so configured will now be described.

Figure 5:
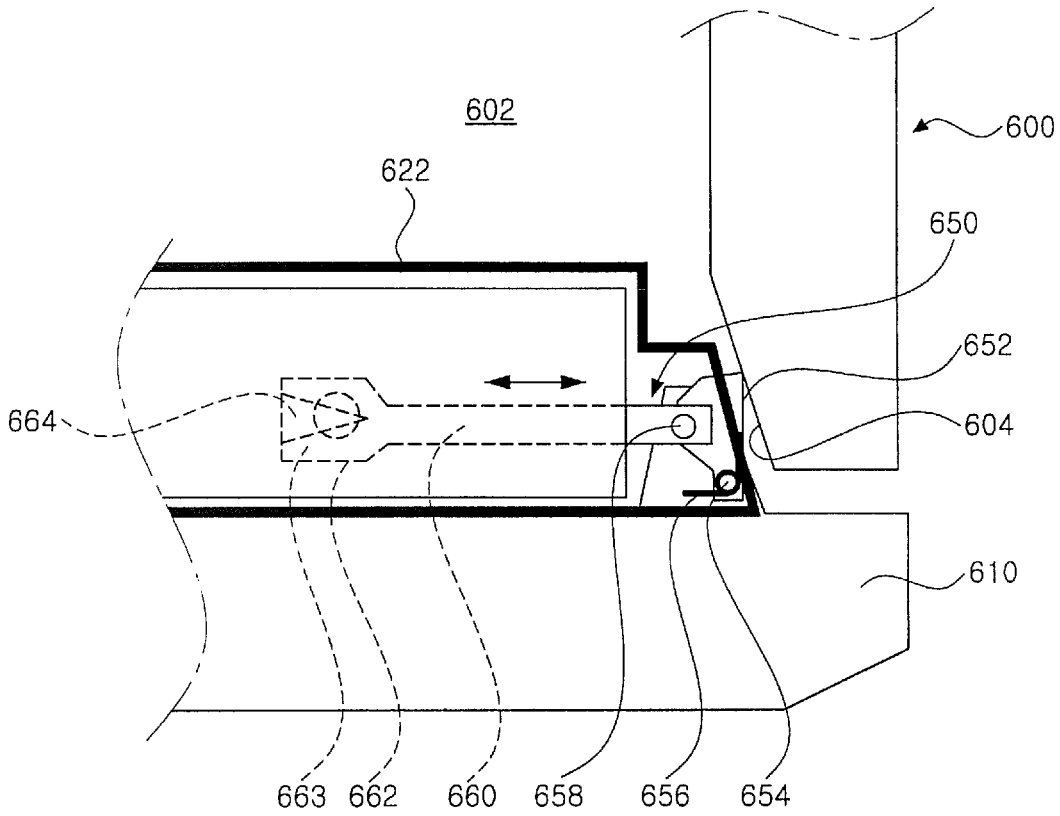
FIGS. 5-8 are various views of another exemplary ice tray assembly for a refrigerator as embodied and broadly described herein.
Figure 6:
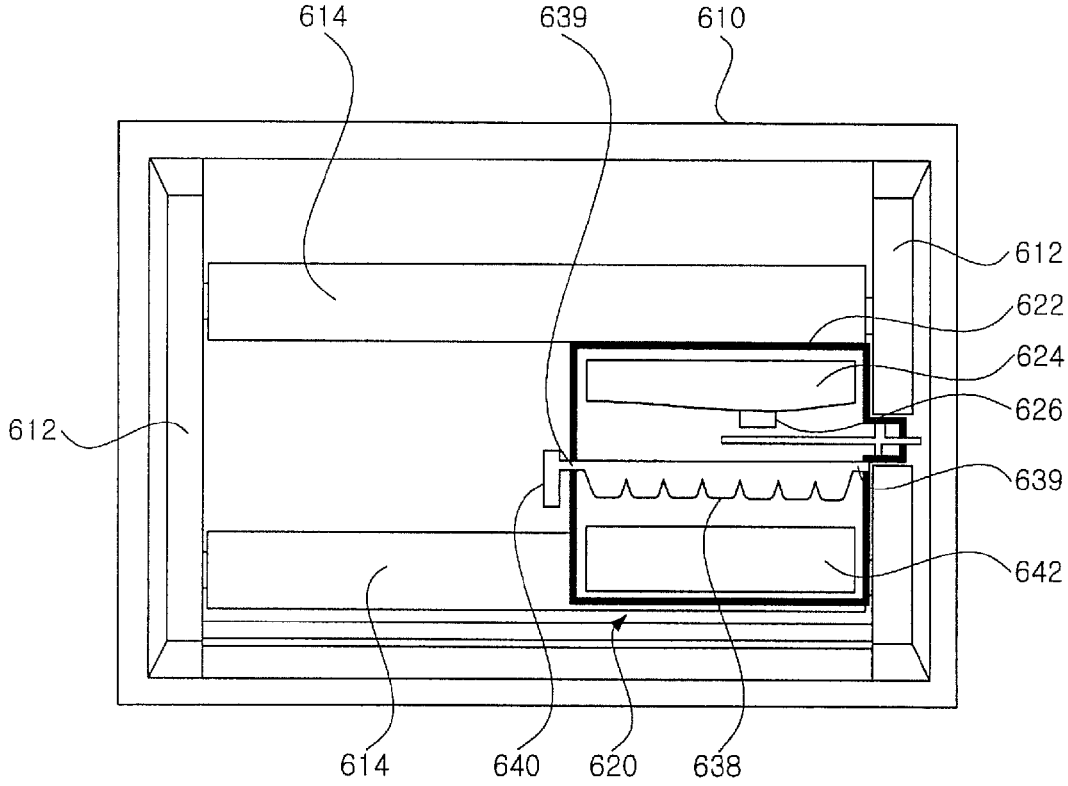

First, if the door 610 is closed, the driving cam 652 is supported by the flared surface 604 of the refrigerator main body 600 and is contained substantially within the case 622, as shown in FIG. 5. Thus, the opening and closing lever 660 is also contained within the case 622. The cooperating portion 636 of the valve stem 630 is positioned at a relatively higher position of the opening and closing drive inclined surface 663 formed in the lift driving portion 662 of the opening and closing lever 660. This causes the valve stem 630 and the plug 632 to be lifted to a corresponding level, and the sealing material 634 to be disengaged from the water discharging hole 628. In such a state, if water is contained in the water bucket 624, the water can be discharged through the water discharging hole 628 and delivered to the ice tray 638.

Figure 8:
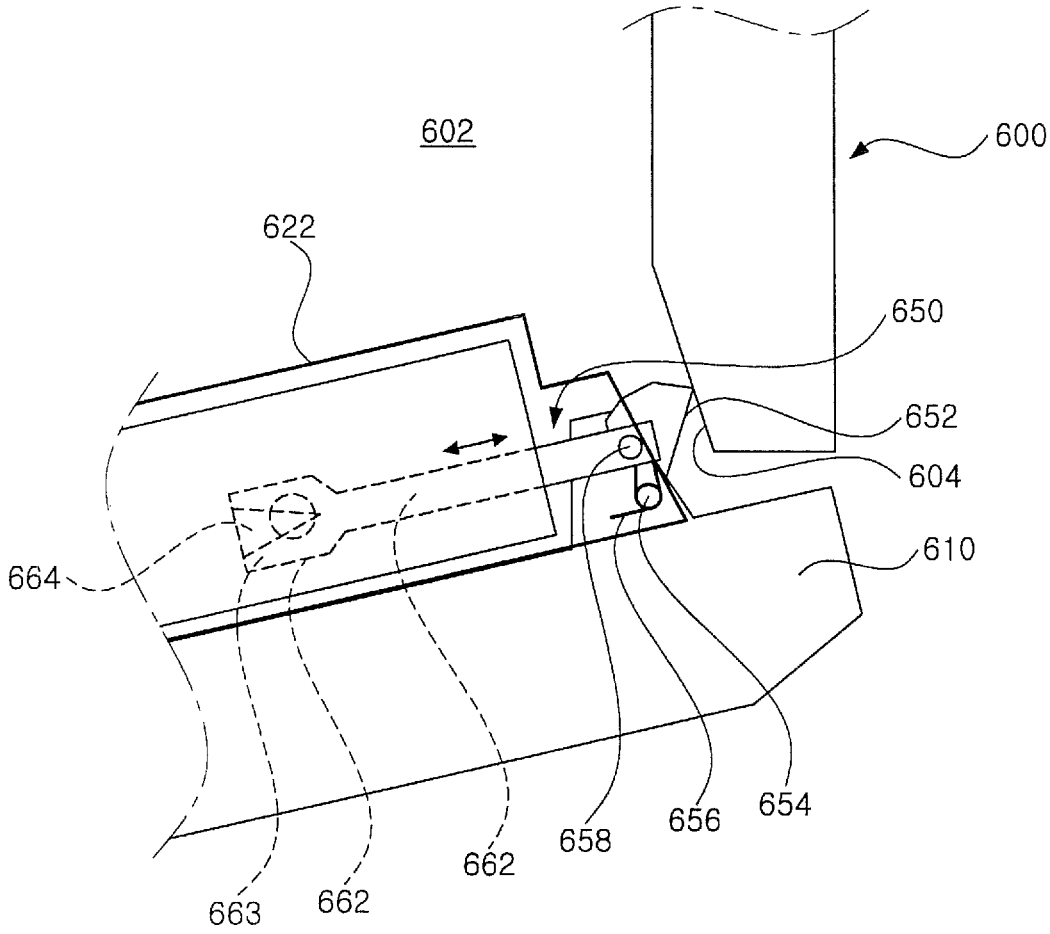

If a user opens the door 610, the door 610 is rotated to open the storage space 602, and the ice tray assembly 620 is moved together with the door 610, as shown in FIG. 8. However, the driving cam 652 is rotated by the elastic force of the elastic member 656 and thus maintains contact with the flared surface 604. Accordingly, the opening and closing lever 660 also cooperates with the driving cam 652 and moves toward the outside of the case 622.

The movement of the opening and closing lever 660 changes the position in which the lift driving portion 662 and the cooperating portion 636 of the valve stem 630 are in contact with each other. This causes the valve stem 630 to drop, either by its own weight or water pressure, and the plug 632 to press the sealing material 634, thereby closing the water discharging hole 628. Thus, since the lift driving portion 662 of the opening and closing lever 660 does not support the valve stem 630 in an open position the door 610 is opened, the valve 628 is closed and water in the water bucket 624 cannot be delivered to the ice tray 638. Further, when the door 610 is closed, the driving cam 652 is pressed by the inner surface of the refrigerator main body 600 and enters the case 622, thereby lifting up the valve stem 630. If the valve stem 630 is lifted up, the water discharging hole 628 is opened, so that water in the water bucket 624 can be delivered to the ice tray 638.

In order to supply water to the ice tray 638, the door 610 is opened, and the water bucket 624 is separated from the case 622. After filling the water bucket 624 with water, the water bucket 624 is re-installed on the case 622. As shown in FIG. 8, when the door 610 is open, the valve 628 cannot be opened, and water in the water bucket 624 cannot be discharged to the tray 638.

If the door 610 is then closed after re-installing the water bucket 624, the opening and closing lever 660 is driven and thus opens the valve 628. That is, the moment the door 610 is completely closed, the valve stem 630 of the valve 628 is lifted up by the opening and closing lever 660 and then the water discharging hole 628 is opened. Thus, water in the water bucket 624 may be delivered to the ice tray 638. The water delivered to the ice tray 638 may then be made into ice in the storage space 602.

Figure 9:
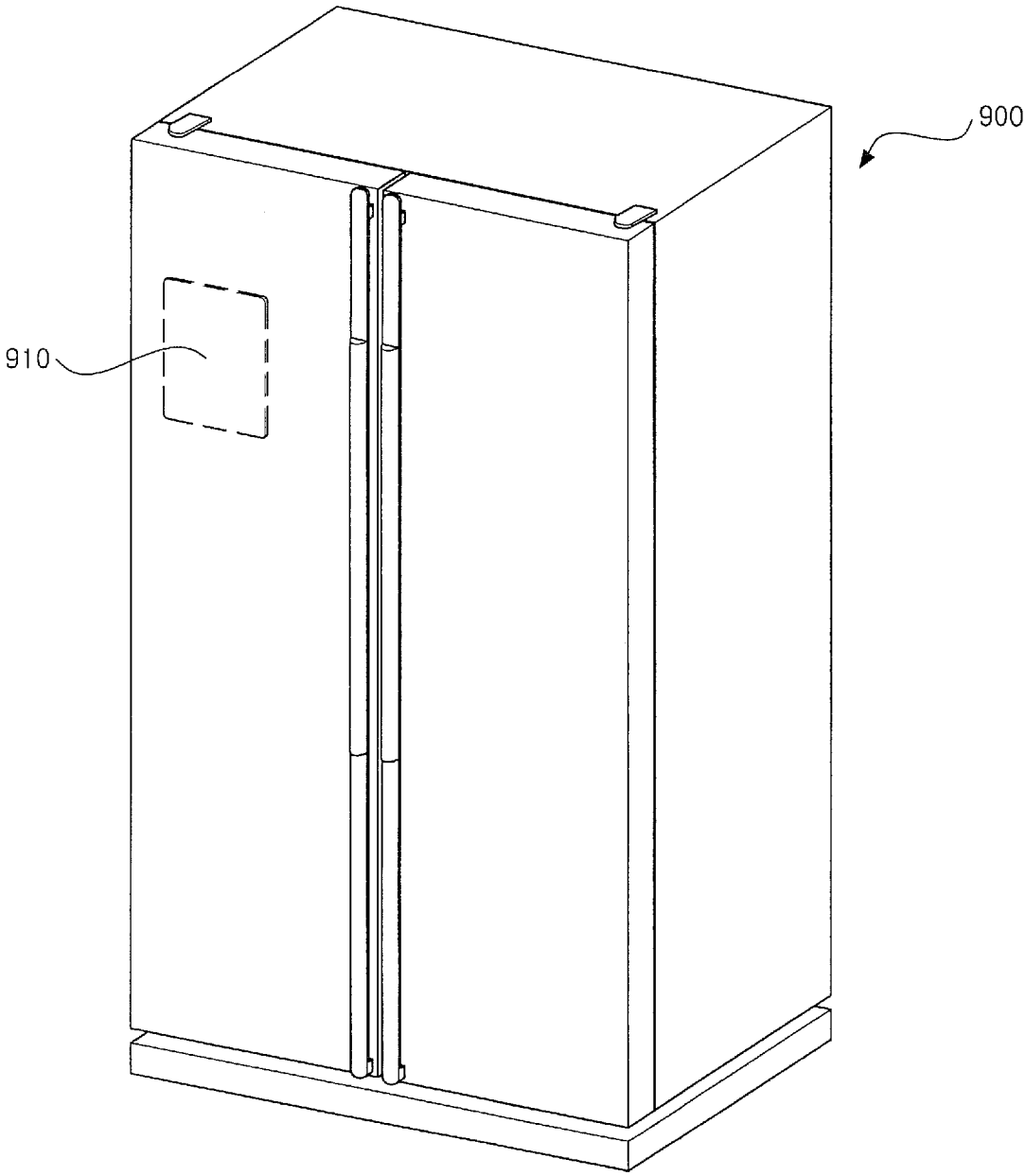
FIGS. 9-15 are front perspective views of exemplary refrigerators having an ice tray assembly as embodied and broadly described herein.
Figure 10:
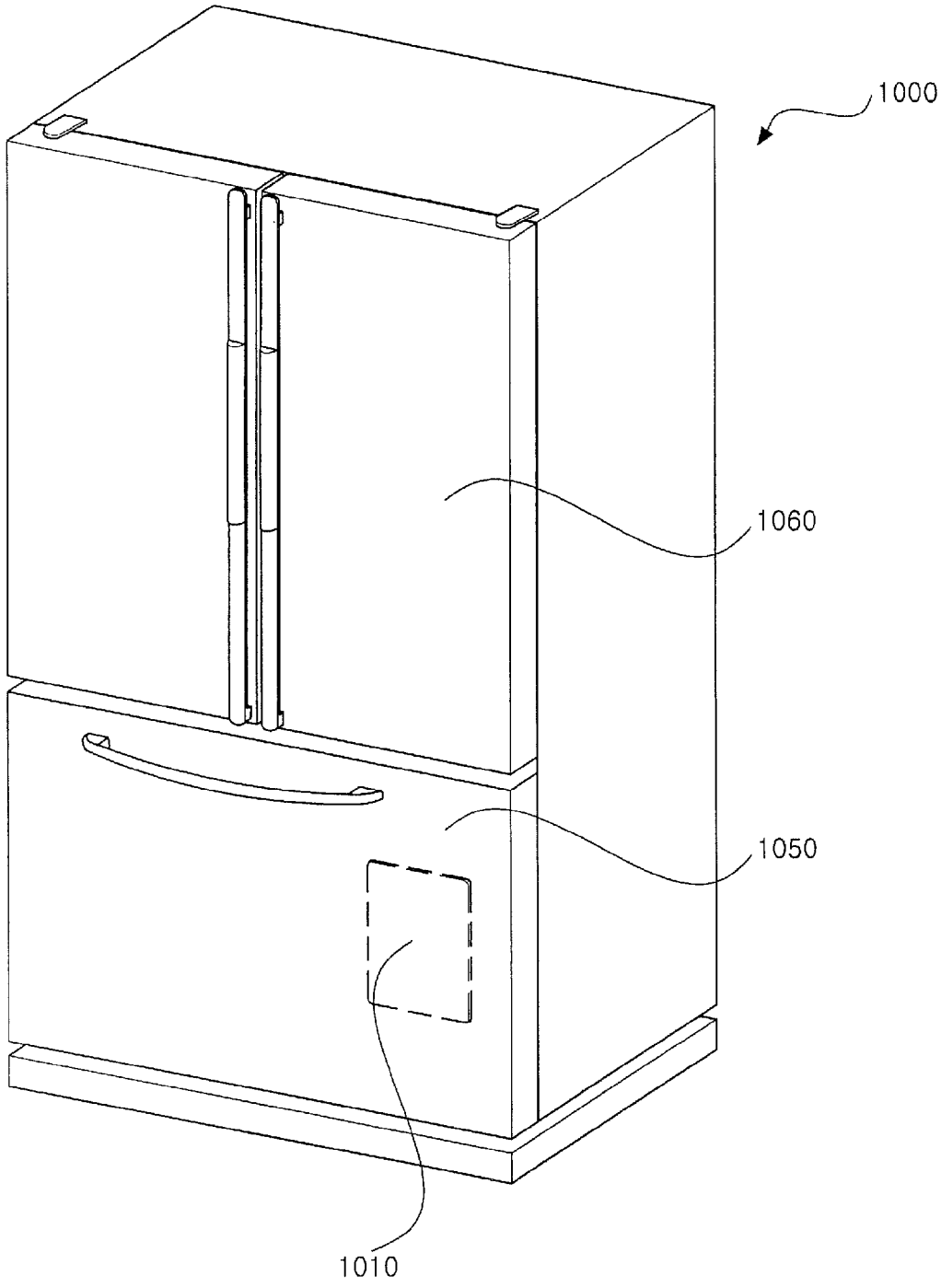
Figure 11:
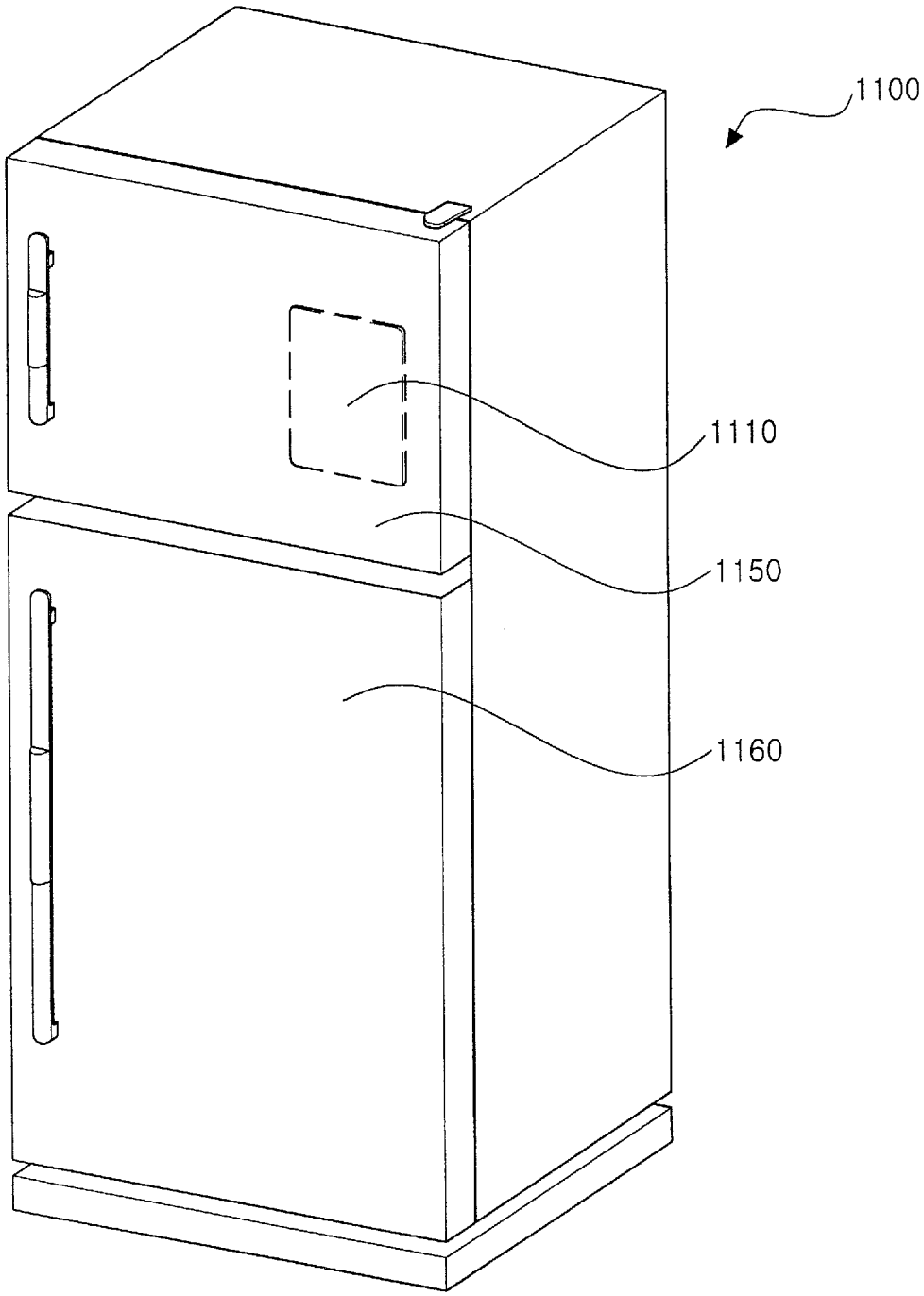
Figure 12:
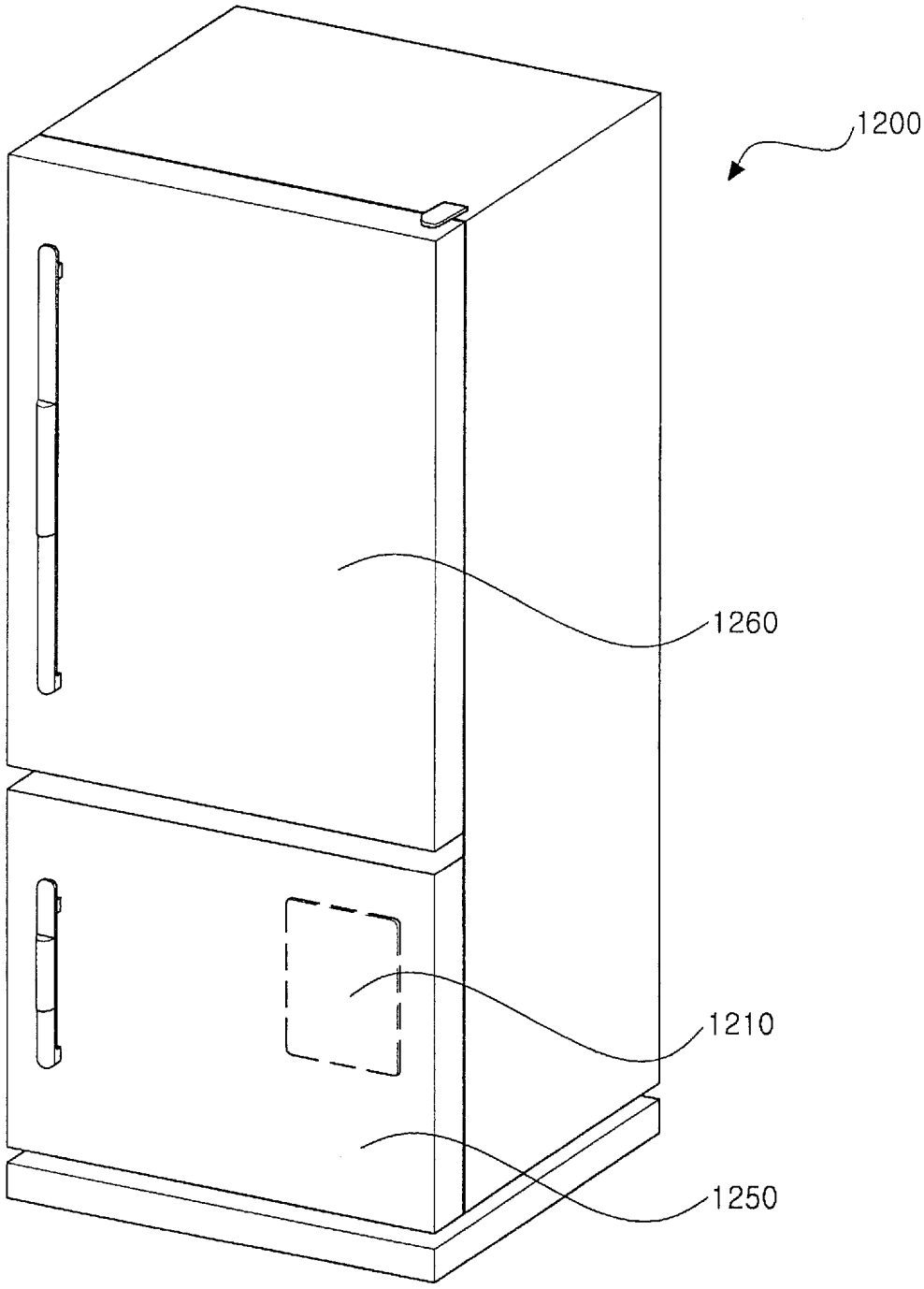
Figure 13:
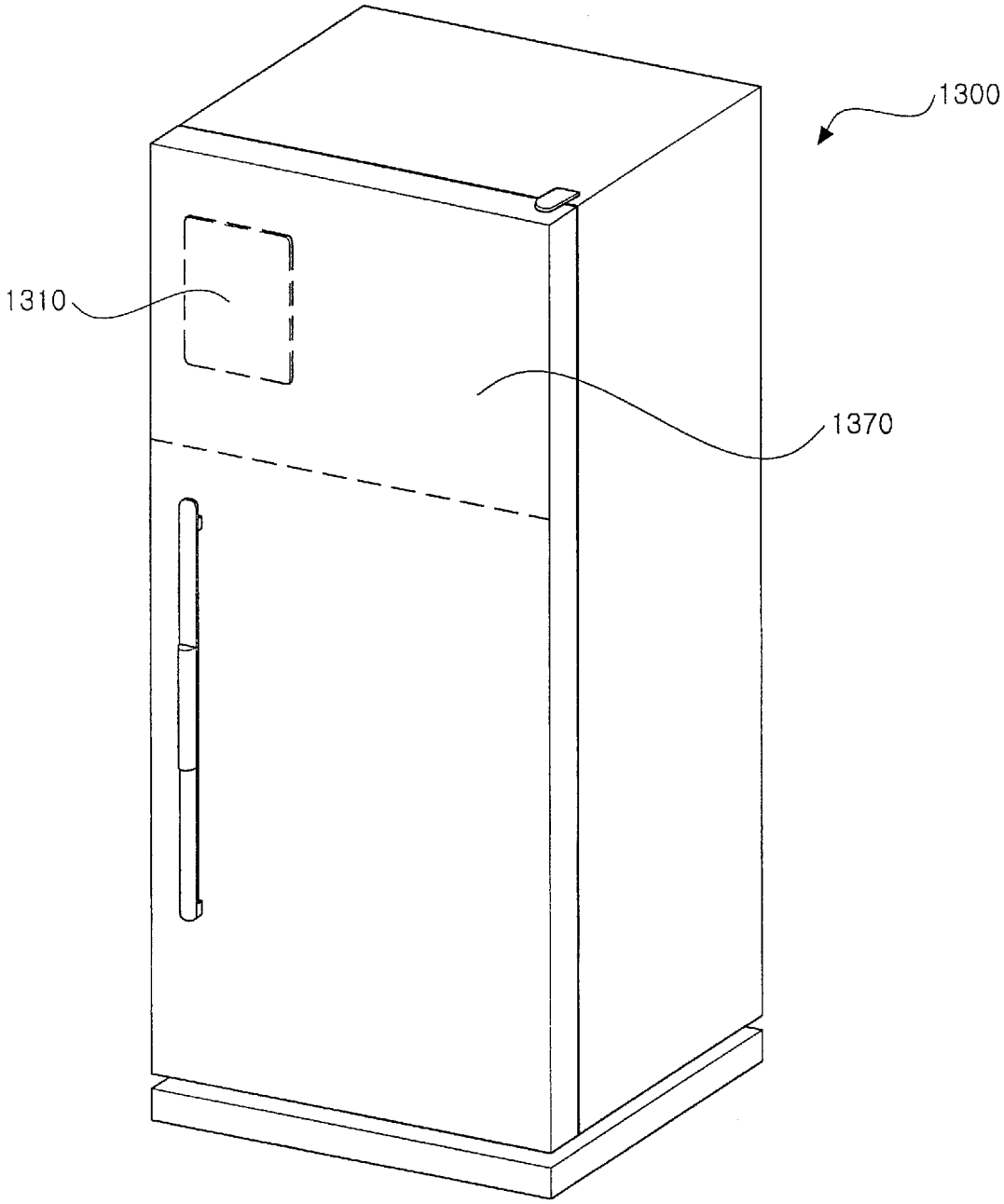
Figure 14:
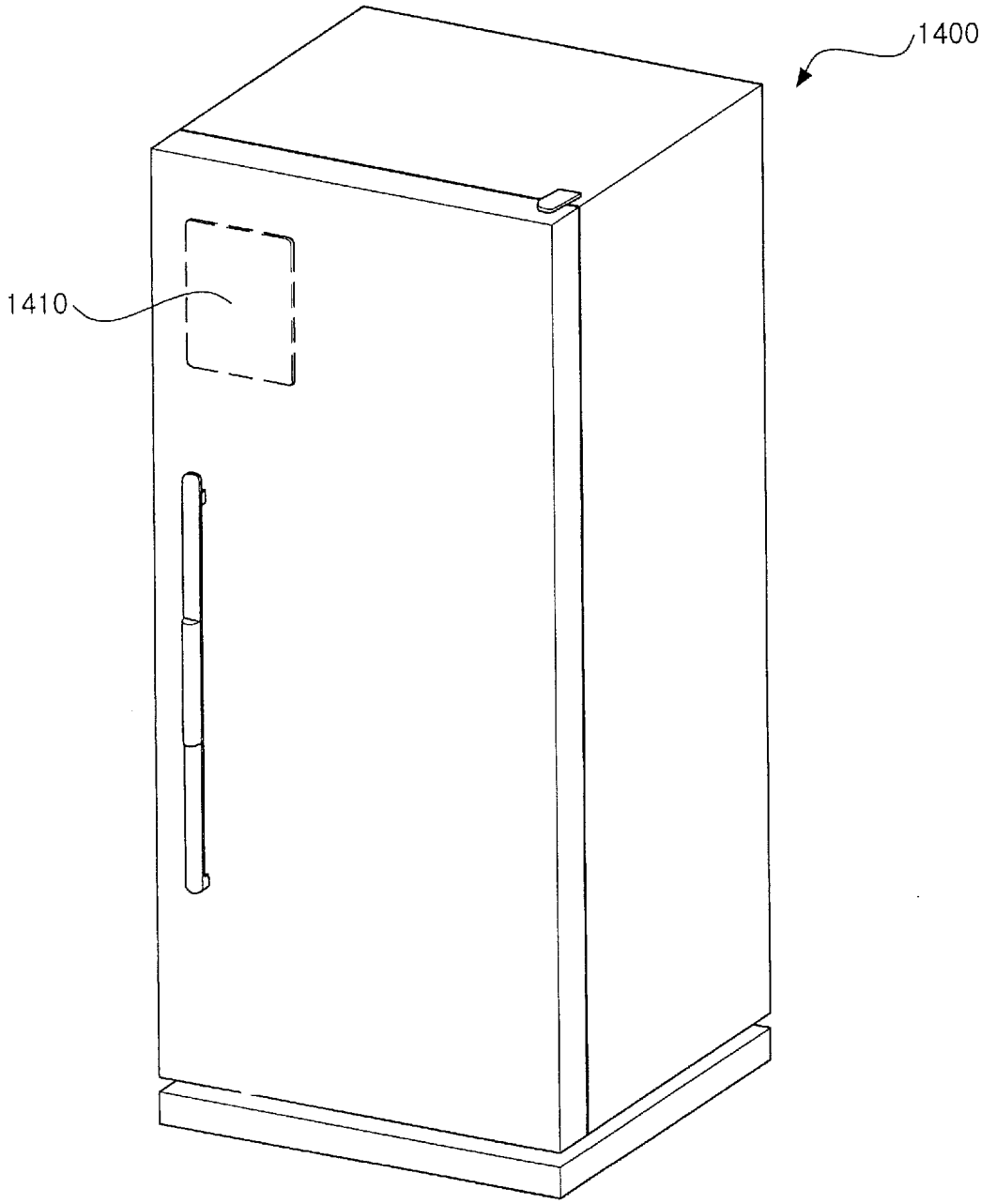
Figure 15:
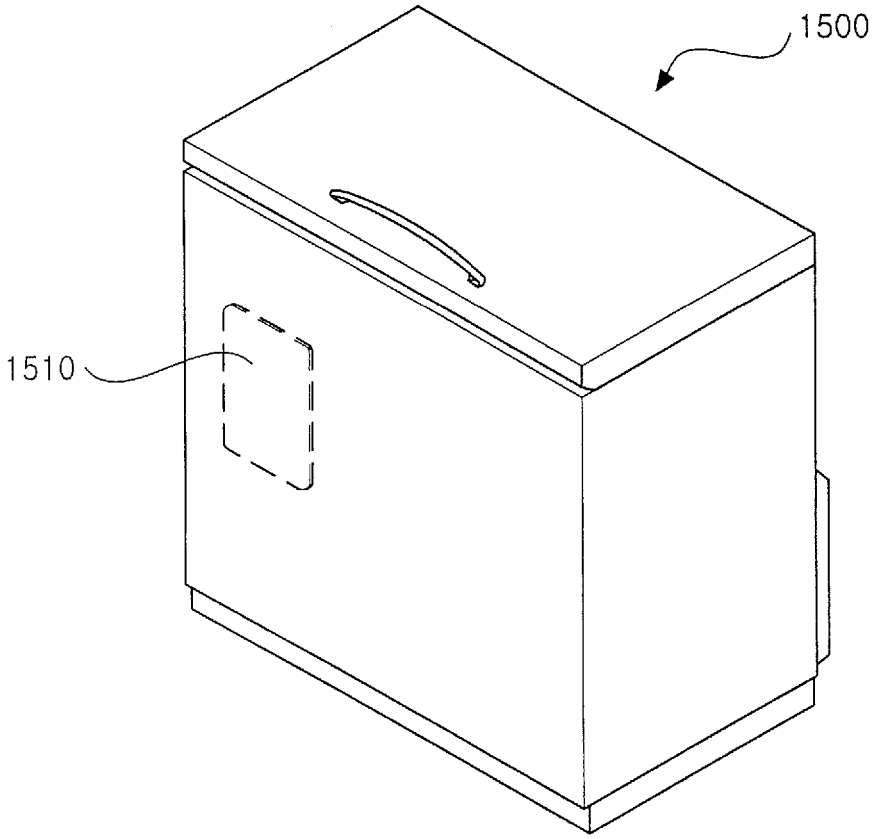

An ice tray assembly as embodied and broadly described herein may be applied to numerous different types of refrigerators. One such exemplary application is shown in FIG. 9, in which an ice tray assembly 910 as embodied and broadly described herein is installed in a side by side refrigerator/freezer 900. Another such exemplary application is shown in FIG. 10, in which an ice tray assembly 1010 as embodied and broadly described herein is installed in a refrigerator/freezer 1000 with a bottom freezer compartment 1050 and French door refrigerating compartment 1060. Still other such exemplary applications are shown in FIGS. 11-15, in which an ice tray assembly 1110, 1210, 1310, 1410, 1510, respectively, as embodied and broadly described herein is installed in a refrigerator/freezer 1100 with a top freezer compartment 1150 and a bottom refrigerating compartment 1160, as shown in FIG. 11, in refrigerator/freezer 1200 with a bottom freezer compartment 1250 and a top refrigerating compartment 1260, as shown in FIG. 12, and in a refrigerator 1300 which includes a single door 1370 which covers both the refrigerating and freezing compartments, as shown in FIG. 13. Likewise, as shown in FIGS. 14 and 15, an ice tray assembly 1410, 1510, respectively, as embodied and broadly described herein may be installed in a stand up freezer 1400 or a chest type freezer 1500, which each have a single compartment.

Descriptions of refrigerators, and particularly, refrigerators having ice making capabilities, can be found in, for example, U.S. Pat. Nos. 7,107,364, 7,107,363, 6,945,068, 6,725,685 and 6,588,227, which are subject to an obligation of assignment to the same entity, and the entirety of which is incorporated herein by reference.

The ice tray assembly disclosed herein may have at least the following advantages. An ice tray assembly as embodied and broadly described herein may be installed in a door, thereby enabling a storage space in a refrigerator main body to be used more effectively. Therefore, it may be possible to effectively accommodate more stored goods in the refrigerator main body and to effectively use the storage space.

In addition, although the ice tray assembly is installed in the door, water from a water bucket is not delivered to an ice tray when the door is opened, and the water in the water bucket can be delivered to the ice tray only when the door is closed, thus possibly preventing water from being spilt when feeding water to the ice tray.

An ice tray assembly as embodied and broadly described herein may be installed to a door for opening and closing a storage space of a refrigerator main body, and it may be possible to feed water from a water bucket to an ice tray in an ice tray assembly installed to a door only when the door is closed.

A valve for feeding water from the water bucket to the ice tray may be designed so as to be open when the door is closed and closed when the door is open.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice tray assembly, comprising:

an outer casing configured to be mounted to a door of a freezing compartment of a refrigerator;

an inner casing configured to be inserted into the outer casing;

at least one ice tray rotatably installed in the inner casing, wherein the at least one ice tray comprises an inner space configured to receive water therein, wherein the inner space is partitioned into a plurality of spaces in which ice is made;

a rotation assembly coupled to the at least one ice tray and configured to rotate the at least one ice tray;

a bin configured to receive ice formed in the at least one ice tray when the ice is released from the at least one ice tray;

a water container in fluid communication with the at least one ice tray; and a valve configured to control a supply of water to the at least one ice tray, wherein the valve is configured to open so as to supply water to the at least one ice tray when the door is closed, and to close so as to restrict a supply of water to the at least one ice tray when the door is open, wherein the valve comprises:

a head configured to selectively cover an opening in a lower portion of the water container;

a stem which extends from the head into an interior of the water container;

a projection formed at an end of the stem opposite the head;

an elastic member interposed between the projection and a corresponding inner surface of the lower portion of the water container; and a lever which extends from the interior of the water container through a cover which covers an upper portion of the water container such that an upper end portion of the lever that extends through the cover protrudes out beyond the cover when the door is open and a lower end portion of the lever is positioned facing the projection, and wherein the upper end portion of the lever is configured to be depressed in response to contact with a shelf positioned in the freezing compartment when the door is closed so as to force the upper end portion of the lever into the water container and press the lower end portion of the lever against the protrusion to move the head away from the opening in the lower portion of the water container to open the valve and supply water to the at least one ice tray.

2. The ice tray assembly of claim 1, wherein the rotation assembly comprises:

at least one rotary gear coupled to a first end of the at least one ice tray; and a rotary lever coupled to the at least one rotary gear, wherein the at least one rotary gear is configured to rotate the at least one ice tray in response to a movement of the rotary lever.

3. The ice tray assembly of claim 2, further comprising:

at least one groove formed in a surface of the inner casing corresponding to a second end of the at least one ice tray opposite the first end of the at least one ice tray, wherein the at least one groove is configured to slidably engage a portion of the second end of the at least one ice tray so as to limit a rotation of the second end of the at least one ice tray as the rotary lever is moved.

4. The ice tray assembly of claim 2, wherein the at least one ice tray comprises a plurality of ice trays arranged in a vertical stack, wherein each of the plurality of ice trays has a corresponding rotary gear coupled to a first end thereof, and wherein a connection gear is interposed between each pair of rotary gears so as to cause each of the rotary gears to rotate together as the rotary lever is moved.

5. The ice tray assembly of claim 1, further comprising a cover rotatably coupled to the at least one ice tray and configured to selectively cover an open upper side of the at least one ice tray, wherein the cover is configured to rotate about a hinge and uncover the open upper side of the at least one ice tray when at least one ice tray rotates in response to the movement of the rotary lever.

6. The ice tray assembly of claim 5, wherein the cover comprises a feed port through which water supplied by the water container is introduced into the at least one ice tray.

7. The ice tray assembly of claim 1, wherein the lever is configured to contact the projection and compress the elastic member so as to move the head away from the opening in the lower portion of the water container and open the valve when the door is closed.

8. The ice tray assembly of claim 1, wherein the lever is configured to release a force on the projection so as to move the head into the opening in the lower portion of the water container and close the valve when the door is open.

9. A refrigerator comprising the ice tray assembly of claim 1.

10. A refrigerator, comprising:

a refrigerating chamber;

a door configured to cover an opening of the refrigerating chamber; and an ice tray assembly coupled to an inside of the door, wherein the ice tray assembly comprises:

a casing coupled to the door;

at least one ice tray installed in the casing;

a rotation assembly installed in the casing and configured to rotate the at least one ice tray in the casing so as to release ice from the at least one ice tray into a bin a water container in fluid communication with the at least one ice tray; and a valve configured to control a supply of water to the at least one ice tray, wherein the valve is configured to open so as to supply water to the at least one ice tray when the door is closed, and to close so as to restrict a supply of water to the at least one ice tray when the door is open, wherein the valve comprises:

a head configured to selectively cover an opening in a lower portion of the water container;

a stem which extends from the head into an interior of the water container;

a projection formed at an end of the stem opposite the head;

an elastic member interposed between the projection and a corresponding inner surface of the lower portion of the water container; and a lever which extends from the interior of the water container through a cover which covers an upper portion of the water container and having an upper end portion that protrudes out beyond the cover when the door is open and a lower end portion of the lever positioned facing the projection, wherein the upper end portion of the lever is configured to be depressed in response to contact with a shelf positioned in the refrigerating compartment when the door is closed so as to force the upper end portion of the lever into the water container and press the lower end portion of the lever against the protrusion to exert a force on the protrusion that moves the head away from the opening in the lower portion of the water container to open the valve and supply water to the at least one ice tray.

11. The ice tray assembly of claim 10, wherein the rotation assembly comprises:

at least one rotary gear coupled to a first end of the at least one ice tray; and a rotary lever coupled to the at least one rotary gear, wherein the at least one rotary gear is configured to rotate the at least one ice tray in response to a movement of the rotary lever.

* * * * *